US006393745B1

(12) United States Patent
Miki

(10) Patent No.: US 6,393,745 B1
(45) Date of Patent: May 28, 2002

(54) DISPLAY MEDIA BACK PACK AND METHOD OF VISUAL DISPLAY

(76) Inventor: Emiko Miki, 1400 Venice Blvd., #203, Venice, CA (US) 90291

( * ) Notice: Subject to any disclaimer, the term of this patent is extended or adjusted under 35 U.S.C. 154(b) by 0 days.

(21) Appl. No.: 09/275,600

(22) Filed: Mar. 24, 1999

Related U.S. Application Data

(60) Provisional application No. 60/101,932, filed on Sep. 24, 1998.

(51) Int. Cl.[7] ..... G09F 21/02

(52) U.S. Cl. ..... 40/586; 224/627; 224/645; 224/655; 224/930

(58) Field of Search ..... 312/7.2; 348/838; 224/645, 627, 655, 930; 40/586

(56) References Cited

U.S. PATENT DOCUMENTS

| | | | | | |
|---|---|---|---|---|---|
| 1,047,779 | A | * | 12/1912 | Francis | 40/586 |
| 3,570,158 | A | * | 3/1971 | Hackett | 40/586 X |
| 4,195,836 | A | | 4/1980 | Beyer | 273/1 R |
| 4,462,525 | A | * | 7/1984 | Pingleton et al. | 224/930 X |
| 4,574,269 | A | | 3/1986 | Miller | 340/97 |
| 4,635,110 | A | * | 1/1987 | Weinblatt | 348/838 X |
| 4,646,157 | A | | 2/1987 | Wakai et al. | 358/236 |
| 4,709,307 | A | | 11/1987 | Branom | 362/103 |
| 4,754,271 | A | | 6/1988 | Edwards | 340/784 |
| 4,988,025 | A | | 1/1991 | Lipton et al. | 224/277 |
| 5,023,706 | A | * | 6/1991 | Sandberg | 348/838 |
| 5,100,214 | A | * | 3/1992 | Kitaue | 312/7.2 X |
| 5,222,642 | A | * | 6/1993 | Solarz | 224/645 X |
| 5,255,834 | A | | 10/1993 | Bendersky | 224/209 |
| 5,335,076 | A | * | 8/1994 | Reh et al. | 312/7.2 X |
| 5,375,044 | A | | 12/1994 | Guritz | 362/104 |
| 5,397,160 | A | * | 3/1995 | Landry | 224/929 X |
| 5,409,152 | A | * | 4/1995 | Trevino | 224/930 X |
| 5,551,615 | A | * | 9/1996 | McIntosh | 224/930 X |
| 5,570,828 | A | * | 11/1996 | Lewis | 224/627 |
| 5,632,044 | A | * | 5/1997 | Sloot | 40/586 X |
| 5,690,411 | A | | 11/1997 | Jackman | 362/103 |
| 5,704,527 | A | | 1/1998 | Struzer | 224/547 |
| 5,706,992 | A | | 1/1998 | Moor | 224/657 |
| 5,722,192 | A | | 3/1998 | Salley | 40/329 |
| 5,724,225 | A | | 3/1998 | Hrusoff et al. | 361/683 |
| 5,730,638 | A | | 3/1998 | Ward | 446/297 |
| 5,738,263 | A | | 4/1998 | Lewis | 224/627 |
| 5,740,037 | A | | 4/1998 | McCann et al. | 364/400 |
| 5,774,338 | A | | 6/1998 | Wessling, III | 361/730 |
| 5,791,488 | A | | 8/1998 | Lee | 206/768 |
| 5,798,733 | A | | 8/1998 | Ethridge | 342/357 |
| 5,897,042 | A | * | 4/1999 | Sims | 224/645 X |
| 5,912,653 | A | * | 6/1999 | Fitch | 345/87 |
| 5,991,133 | A | * | 11/1999 | Myers | 348/838 X |

FOREIGN PATENT DOCUMENTS

| | | | | |
|---|---|---|---|---|
| GB | 6231 | * | of 1887 | 40/586 |

* cited by examiner

*Primary Examiner*—Brian K. Green
*Assistant Examiner*—James M. Hewitt
(74) *Attorney, Agent, or Firm*—Trojan Law Offices

(57) ABSTRACT

A device for containing a play back device for displaying and/or advertising commercial material and wherein the device is carried on the back or chest of a person to uniquely advertise or a fashion item or, in an eye-catching manner, one's goods, philosophies and/or services, particularly useful in close quarters as would be found at trade shows and the like.

3 Claims, 2 Drawing Sheets

DISPLAY MEDIA BACK PACK AND METHOD OF VISUAL DISPLAY

CROSS-REFERENCES TO RELATED APPLICATIONS

This is a regular patent application predicated upon Provisional Patent Application No. 60/101,932 filed Sep. 24, 1998, the entirety of which is hereby incorporated by reference.

BACKGROUND OF THE INVENTION

1. Field of the Invention

The present invention relates to a visual-audio display member and to another means of advertising or marketing, or giving visual and audio information in a unique manner. More particularly, the present invention is directed towards an assembly or a back pack of the type that may be displayed exteriorly of the back and the like of a person. The assembly may take any exterior configuration just so long as an interior space is provided and a cut out window or aperture permits visual display. Even more specifically and basically, the invention is directed to a back pack that has an aperture or opening and wherein a lightweight video play back or motion picture play back monitor is aligned in the aperture or opening so as to present pictorial, animated, or other graphic visual representations with or without sound for various purposes. The device inside the member includes, but is not limited to a video CD, DVD, Hi 8, mini CD, portable computer, organizer/note book, portable game machine which includes "Digital downloadable audio visual player, organizer and portable computer with plug in for telephone, cable and satellite to download or broadcast the content, Internet (web-site) display through satellite connection as well as Internet (web-site) display through regular Internet connection using a cellular telephone to attract on line advertisers, using remote control or inferred device to have interactivities with people during the promotion, having a camera around the eye or the head to record the live feed directly shown on the display as well as the regular content and may be used to mix together, LCD screen with memory chip or such similar devices. Thus, any form of mechanical and electrical devices having a visual display monitor or screen with or without audio is contemplated in the practice of the invention. One of the more specific purposes of the invention would be the utilization of a high eight video to video CD and DVD play back with, for example, an LCD screen and battery to play commercials or promotions that may be utilized at trade shows, movie openings, street promotions and the like. Other devices such as GAMEBOY, or any portable game machine with a screen may also be used.

2. Description of the Related Art

In advertising or marketing, or visually displaying information, the commonplace T.V. monitor with associated VCR is ubiquitous to profile various manufacturer's goods particularly in the fashion line. That is, if one goes into a clothing or department store and more specifically, a clothing area where fashions are displayed, one will usually find a T.V. monitor with or without music for displaying wears of a various nature so as to attract the eye of the would-be purchaser. Obviously, one could record one's own image and play the recording back which application would have great appeal to school girls and others. In other instances, static display boards, posters, and the like have been known but, as far as currently known, no one has proposed a device to which the current application is directed which, in one sense, is an updated modern version of a walking billboard that was prevalent in the 1920's to advertise products or goods.

That is, the modern age has now produced the capability of having a fairly lightweight, miniaturized, animated in-color or black and white advertising media particularly useful for advertising goods and/or services.

A search of related art has been conducted and pertinent references found in the search are as follows:

U.S. Pat. No. 5,798,733

This reference is directed to an interactive position guidance apparatus and method for guiding a user to reach a predetermined target position. As shown in FIG. 1, the position guidance apparatus 100 is preferably one that is relatively small enough as to be mounted on an appendage of the user. The position guidance apparatus 100 preferably provides a 3×5 inch lighted graphical display, for example. The display 20 is preferably a 3×5 inch lighted liquid crystal graphical display, as shown in FIG. 2. As shown in FIG. 3, the position guidance apparatus 100 further includes a centrally located CPU 30 which receives GPS signals from GPS receiver 200. The CPU 30 is further connected to an electronic compass 80 and digital altimeter 70 to receive directional and altitude signals therefrom. Further connected to CPU 30 is a memory 40, a plug-in memory 50, a keypad 10, and a display 20.

U.S. Pat. No. 5,704,527

This reference is directed to an encasement enclosed portable attachable/detachable entertainment unit: "The Box". FIG. 2 illustrates a tubular shaped clip 1, the base for the attachment, and the curved extension 2 of the tubular clip 1 which holds the clip in place. FIG. 3 illustrates an open encasement box 3 attached by its hollowed out shaft 28 to the clips 1. The clips 1 Care attached to the stroller handles 4 by their curved extensions, screws, and nuts, which are not shown in this Figure. As shown in FIG. 6, hanging off the square rings 6, there are canvas straps 7. The canvas straps 7 attach to the square rings 6 on the secured extensions 10 by means of a double-stitched loop on the canvas straps 7. FIG. 9 shows a canvas or leather strap 14 which is suspended on the stroller handles 4 via looping into metal or plastic curved extensions 19. The entertainment encasement is designed to hold one or several of: radio, TV, cassette player,. CD player, video player, etc.

U.S. Pat. No. 4,709,307

This reference is directed to clothing with illuminated display. FIG. 1 illustrates an article of clothing 11, although it should be understood that any other article of clothing, such as the top of an exercise or jogging outfit, or an exercise vest, could also made in accordance with the present system. Overlay 17 has imprinted thereon in a contrasting color or the like a background pattern 23 of generally the same shape as the pattern formed by border diodes 19, and a background pattern 25 of generally the same shape as the letter-forming diodes 21. The pattern formed by letter diodes 21 can be suitably selected to spell the name of a company for advertising purposes, or it can make up any other desirable pattern.

U.S. Pat. 4,646,157

This reference is directed to a pocket television receiver. As shown in FIG. 1, the pocket television receiver 10 is comprised of a receiver body 11, display device 12, and a headphone 13. The display device 12 is configured and sized similarly to a wristwatch and is adaptable for attachment on the wrist of a user. The display device 12 has a strap 27 which, like a wristwatch, is fitted to the wrist of the user and also includes a high density dot liquid crystal panel 29 attached to the surface of a central portion of a case 28 of the display device 12.

U.S. Pat. No. 5,722,192

This reference is directed to a moving decorative display for articles of clothing. As shown in FIG. 2, the electronic components secured in the housing 20 include a CPU 48 which is provided with a fixed memory which is identified at 50. Display strip 32 is shown with a number of numeric signals displayed which proceed from one end to the other. Indexing and displaying of a set of numbers, letters, or a mix thereof along the strip can be accomplished. This strip is provided with a fixed number of alphanumeric stations. In part, this can be accomplished through the use of LED or LCD displays. In operation, the strip 32 with the housing 20 are affixed to the hat 12 via Velcro material.

U.S. Pat. No. 5,724,225

This reference is directed to a laptop computer carrying tray. As shown in FIGS. 3, 4, and 6, tray 1 is supported by adjustable shoulder straps 30 with a first end 32 and a second end 34 containing clasps 36, 38 securably attached to the holes 10 situated at the backmost corner of sidewall 7 and the holes 12 situated at the frontmost corner of the sidewall 7 of the central carrying tray 1.

SUMMARY OF THE INVENTION

The present invention is directed to a back pack or other device and method that may be adapted to present commercial-type presentations advertising one's goods or services or may be used as a fashion statement as consumer products for the mass market or to visually display any type of representations for a variety of purposes, or just for fun. In other instances where the invention is associated with a lunch box or the like, Aesop type fables may be displayed in order to provide amusement and entertainment value to the user thereof.

Primarily however, the invention is directed to a back pack type device of various configurations, having a central cut-out aperture and wherein the back pack houses a play back device so as to present moving commercial presentation as at trade shows, promotional events, etc., to advertise and promote one's product and/or services. The invention is also directed to a method of advertising or displaying indicia using the back-pack type device of the invention.

While primarily the invention will be directed to advertising and other commercial uses, it also finds use in the consumer products exterior application, including bag-pack, handbags and briefcases. That is teenagers may want to present a video of themselves or of something else that they wish to share with their peer group, or those who are fashion conscious may wish to have displayed in association with their personage, a specific type of video with or without sound and this is contemplated in the-practice of the invention and is so intended to be covered by the appended claims.

OBJECTS OF THE INVENTION

Generally the invention is directed to an assemblage or container which may or may not take the configuration of the ubiquitous back pack or may be a back pack that would be configured in the shape of an animal, a doll or the like, wherein the assemblage or container is adapted to be worn on the front or back of a person and wherein an inner space or volume is provided in which to house a mechanical/electrical display screen or monitor which is visible because of an aperture or cutout in the assemblage or container.

It is an object of the present invention to provide an easily carried, unique display device.

It is another object of the invention to provide an advertising or commercial presentation device which is easily carried and wherein the same may be utilized in close quarters to advertise one's goods and/or services.

It is yet an even more specific object of the invention to provide a back pack with a central aperture wherein the back pack houses a T.V. play back device or a video camera, video CD, DVD, any digital mechanical device with the screen and wherein the device is battery operated whereby various contents may be displayed to advertise, commercialize, and promote one's goods and/or services. The method of using such a device for display and advertising purposes is also an object of the invention.

These and other objects and advantages of the present invention will be apparent from a review of the following specification and accompanying drawings.

DESCRIPTION OF THE PREFERRED EMBODIMENT(S)

Figure 1:
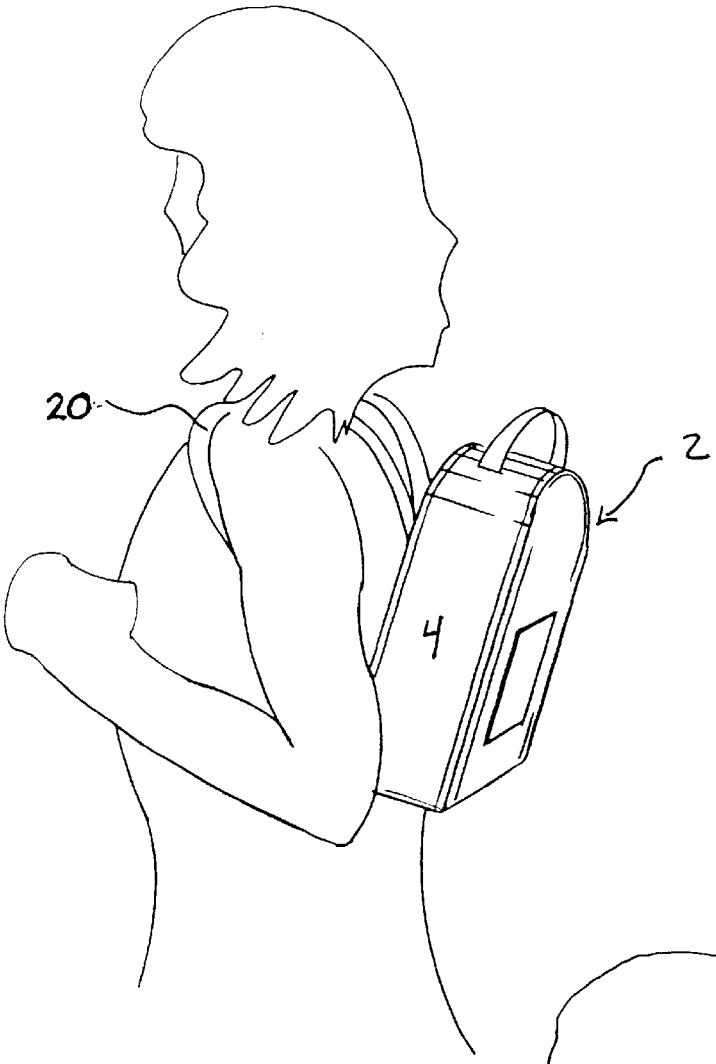
FIG. 1 is a perspective view showing one form of the invention as it may be mounted on the back of a wearer.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments.

However, it is to be understood that the same or equivalent functions and sequence may be accomplished by different embodiments that are also intended to be encompassed within the spirit and scope of the invention.

Referring to the enclosed drawings wherein like numerals of reference designate like elements throughout, it will be seen that the assemblage 2 of the invention here takes the form of the ubiquitously found back pack of general configuration having side walls 4 and 6 and front wall 8 and back wall 10 with bottom wall 12 making up the remainder of a container forming an inner volume or space 14 of a size and configuration sufficiently large to receive therein a video CD, DVD, Hi 8, mini CD, portable computer, or any of the other devices that have been previously disclosed and wherein it is contemplated that any form of mechanical or electrical device having a visual display with or without audio may be used.

It will be noted that while the back pack or assembly 2 is of the shape shown, it is contemplated that other configurations as handbags, briefcases, dolls, animal replications, etc. may be utilized and the general configuration or shape of the assemblage 2 is not important, it only being important that an interior volume such as 14 is formed in order to house devices previously alluded to and which will be more detailed as the description proceeds.

The back pack 2 has, in this particular instance, a handle 16 disposed on the upper wall which is zippered by means of zipper 18 which allows easy access into the interior volume or space 14.

Figure 2:
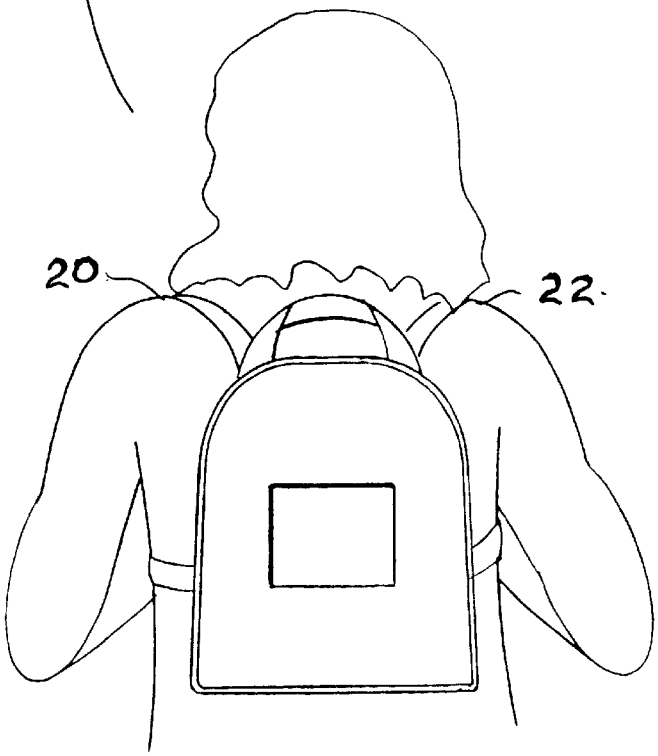
FIG. 2 is a rear view of the FIG. 1 depiction.
Figure 3:
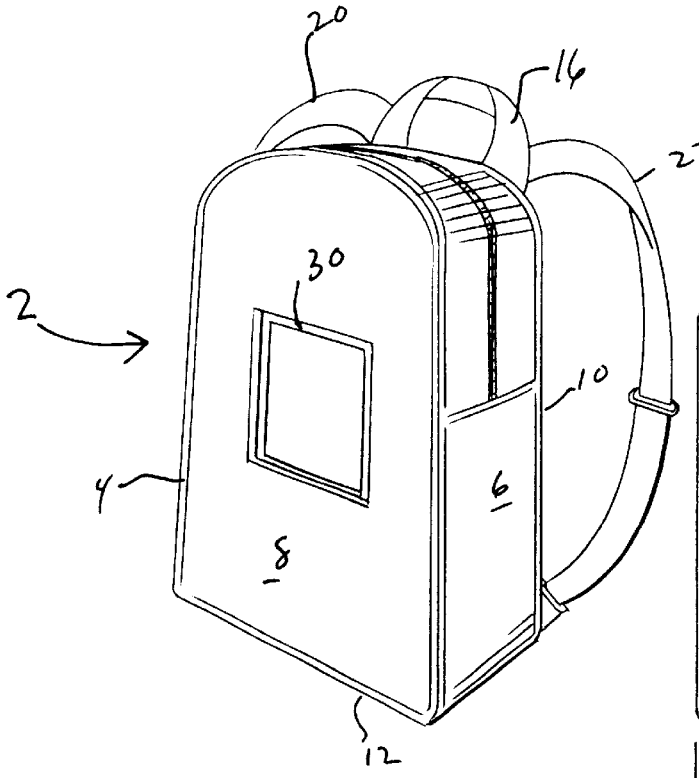
FIG. 3 is a perspective view of one form of the invention.
Figure 4:
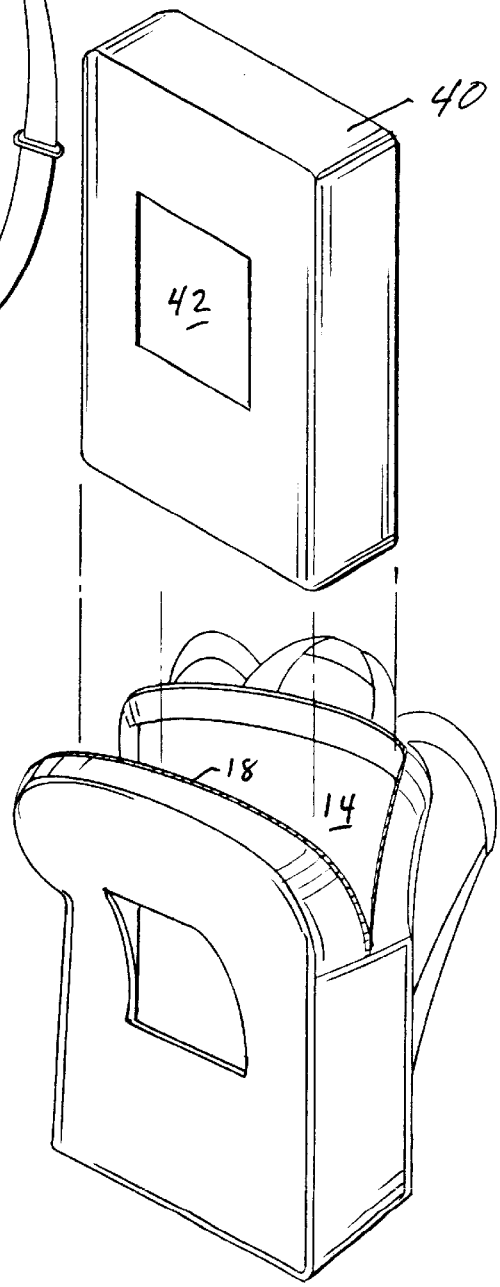
FIG. 4 is another view showing the invention.

Assemblage or back pack 2 has arm straps 20 and 22 by which a person as shown in the drawings, more specifically FIGS. 1 and 2 may carry the back pack 2.

It will be noted that the wall 8 of container 2 has a central aperture or cutout 30 which in most instances will be the same size as a visual display monitor or screen of play back device 40 having monitor screen 42. Preferably, the aperture 30 is reinforced about the perimeter as by well known sewing or other methods so as to prevent ravelling of the material of which wall 8 is fabricated, although device 2 may be totally fabricated of plastic.

In operation of the invention, one merely records on the recording device 40 a visual display with or without audio and puts the device 40 which is battery powered, into the interior volume or space 14 of back pack 2 such that the monitor screen 42 of device 40 is aligned within the aperture or window 30 of container or assemblage 2.

The device 40 is then turned on by means not shown, but which is generally known in the art and the wearer of the device is free to circulate in either close quarters as may be found in a convention to advertise and display products or services or alternately, the recording may be a fashion statement or may be any one of a number of things that people may wish to record and to play back or having interactivities and live feed back directly onto the display monitor using camera or through satellite so that others may see the same. While the device 2 is being illustrated as being carried on the back, it is of course contemplated that the device 2 may be differently configured in shape with appropriate straps, also for handbags and briefcases, so that the same is carried on the chest or front portion of the person who wishes to display, in a visual manner, that which has been previously recorded on a cassette, disk CD, DVD or any digital mediums, inserted in play back device 40.

Thus, there has been disclosed a unique device and method of effectuating visual displays which will have a myriad of uses "commercially and for entertainment purposes."

While the invention has been described as contemplating a back pack or container 2 made of fabric, it is of course contemplated that other materials may be utilized and while a specific configuration is shown, it is of course intended that other configurations may be both desirable and required depending upon the end use to which the invention is to be put and all such changes and modifications will make themselves known to those of ordinary skill in the art and are intended to be covered by the appended claims.

While the present invention has been described with regards to particular embodiments, it is recognized that additional variations of the present invention may be devised without departing from the inventive concept.

What is claimed is:

1. A display media back pack comprising:

a container formed of a flexible material and having at least one arm strap secured thereto for supporting said container on a user's back, said container having a cavity bounded by a plurality of container walls, said plurality of container walls including (a) a back wall adapted to be disposed contiguous the user's back, (b) at least one other wall having an aperture formed there through in open communication with said cavity; and, a play back device disposed in said cavity of said container, said play back device having a wall with a video monitor screen disposed therein and in aligned relationship with said aperture for viewing of a visual display on said video monitor screen through said aperture by persons while said container is worn by the user.

2. The display media back pack as recited in claim 1, wherein said flexible material is fabric.

3. The display media back pack as recited in claim 2, wherein a perimeter edge portion of said aperture is reinforced.

* * * * *